US005406174A

United States Patent [19]

Slegers

[11] Patent Number: 5,406,174

[45] Date of Patent: Apr. 11, 1995

[54] DISCHARGE LAMP OPERATING CIRCUIT WITH FREQUENCY CONTROL OF DIMMING AND LAMP ELECTRODE HEATING

[75] Inventor: Frans Slegers, Eindhoven, Netherlands

[73] Assignee: U. S. Philips Corporation, New York, N.Y.

[21] Appl. No.: 148,106

[22] Filed: Nov. 3, 1993

[30] Foreign Application Priority Data

Dec. 16, 1992 [EP] European Pat. Off. ..... 92203942

[51] Int. Cl.[6] ..... H05B 37/02; H05B 41/36

[52] U.S. Cl. ..... 315/219; 315/DIG. 4; 315/DIG. 7; 315/225

[58] Field of Search ..... 315/219, 223, 224, 225, 315/276, 209 R, DIG. 4, DIG. 5, DIG. 7, 307, 226, 106, 105, 107

[56] References Cited

U.S. PATENT DOCUMENTS

| | | | |
|---|---|---|---|
| 4,682,080 | 7/1987 | Ogawa et al. | 315/209 R |
| 5,103,139 | 4/1992 | Nilssen | 315/219 |
| 5,173,643 | 12/1992 | Sullivan et al. | 315/276 |
| 5,237,243 | 8/1993 | Chung | 315/219 |

FOREIGN PATENT DOCUMENTS 0098285 11/1988 European Pat. Off. .

*Primary Examiner*—Robert J. Pascal
*Assistant Examiner*—Ali Neyzari
*Attorney, Agent, or Firm*—Edward Blocker; Bernard Franzblau

[57] ABSTRACT

A circuit for high-frequency operation of a discharge lamp. The circuit includes a load branch provided with terminals for connection to the discharge lamp and with an electrode heating transformer having a primary winding and secondary windings. Each secondary winding is shunted by a branch comprising an electrode of the discharge lamp. At least one switching element generates a high-frequency current through the load branch from a supply voltage. A control circuit generates a control signal for rendering the switching element conducting and non-conducting at a high frequency. A dimmer circuit is coupled to the control circuit for adjusting the frequency of the control signal. Each branch shunting a secondary winding of the transformer also includes an inductive element and a capacitive element and has a resonance frequency which is different from the resonance frequency of the load branch. Thus, a discharge lamp operated by this circuit can be dimmed over a wide range and provides a comparatively long electrode life and with very little blackening at the ends of the discharge vessel.

11 Claims, 1 Drawing Sheet

DISCHARGE LAMP OPERATING CIRCUIT WITH FREQUENCY CONTROL OF DIMMING AND LAMP ELECTRODE HEATING

BACKGROUND OF THE INVENTION

This invention relates to a circuit arrangement for high-frequency operation of a discharge lamp, comprising input terminals for connection to a supply voltage source, a load branch provided with terminals for accommodating the discharge lamp and with an electrode heating transformer provided with a primary winding and secondary windings, each secondary winding being shunted by a branch comprising an electrode of the discharge lamp, at least one switching element for generating a high-frequency current through the load branch from a supply voltage delivered by the supply voltage source, a control circuit for generating a control signal for rendering the switching element conducting and non-conducting at a high frequency, and a dimmer circuit coupled to the control circuit for adjusting the frequency of the control signal.

Such a circuit arrangement is known from European Patent 98285. The luminous flux of a discharge lamp operated by means of this known circuit arrangement may be adjusted in that the frequency of the control signal is adjusted. A change in the frequency of the control signal leads to a change in the frequency of the high-frequency current through the load branch, so that the impedance of the load branch and the amplitude of the high-frequency current are also changed. A change in the luminous flux of the discharge lamp may thus be achieved through a change in the frequency of the control signal. In the known circuit arrangement, the electrodes of the discharge lamp are heated during lamp operation both by the high-frequency current flowing through the lamp and by an electrode heating current of the same frequency which flows through the electrodes of the discharge lamp as a result of a potential difference between the ends of the secondary windings of the electrode heating transformer during lamp operation. It is ensured through dimensioning of the known circuit arrangement that the temperature of the lamp electrodes is maintained at a suitable value during a lamp operation in which the discharge lamp achieves the highest adjustable luminous flux as a result of the discharge current and the electrode heating current. Lamp electrode life is comparatively long at this suitable value of the electrode temperature. When the luminous flux of the discharge lamp is reduced by a user by means of the dimmer circuit, however, not only the discharge current through the discharge lamp but also the electrode heating current through the electrodes decreases. The temperature of the electrodes as a result drops further below the suitable value in proportion as the luminous flux of the discharge lamp is reduced further. As a result, lamp electrode life is shortened to a comparatively high degree by dimming of the discharge lamp, while at the same time blackening of the ends of the lamp vessel of the discharge lamp takes place.

SUMMARY OF THE INVENTION

The invention has for an object, inter alia, to provide a circuit arrangement by which it is possible to dim a discharge lamp operated by means of the circuit arrangement without adversely affecting the life of the discharge lamp.

According to the invention, a circuit arrangement of the kind mentioned in the opening paragraph is for this purpose characterized in that each branch shunting a secondary winding of the transformer comprises inductive means and capacitive means and each shunt branch has a resonance frequency which is different from the resonance frequency of the load branch.

The resonance frequencies of all branches shunting a secondary winding of the transformer are chosen to be either all lower than the resonance frequency of the load branch or all higher than the resonance frequency of the load branch. It is achieved by this that, at operating frequencies between the resonance frequency of the load branch and the resonance frequency of each branch shunting the ends of a secondary winding, a change in the operating frequency results either in an increase in the discharge current and an accompanying decrease in the electrode heating current, or in a decrease in the discharge current and an accompanying increase in the electrode heating current. This means that, provided the circuit arrangement is suitably dimensioned, the luminous flux of the discharge lamp may be adjusted over a wide range, each luminous flux value of the discharge lamp having an accompanying electrode temperature of the discharge lamp of such a value that the electrode life is comparatively long, while in addition blackening of the lamp vessel ends hardly takes place.

An advantageous embodiment of a circuit arrangement according to the invention is characterized in that the load branch comprises an inductive element, in that the resonance frequency of the load branch has a lower value than the resonance frequencies of the branches shunting the secondary windings, and in that the frequency of the high-frequency current through the load branch is higher for each luminous flux value of the lamp which can be set than the resonance frequency of the load branch and lower than the resonance frequencies of the branches shunting the secondary windings of the electrode heating transformer. Since the frequency of the high-frequency current through the load branch is higher than the resonance frequency of the load branch, the load branch acts as an inductive impedance. Depending on the design of the circuit arrangement, this is an important advantage because the life of the switching elements in the circuit arrangement is comparatively long when the load branch is an inductive impedance. In this advantageous embodiment of a circuit arrangement according to the invention, it is profitable to integrate the inductive element and the electrode heating transformer, so that one component performs different functions in the circuit arrangement. Owing to the comparatively small number of components, the circuit is of a comparatively simple construction, and thus more readily manufactured on a large scale.

BRIEF DESCRIPTION OF THE DRAWINGS

An embodiment of the invention will be explained with reference to the accompanying drawing.

In the drawing.

DESCRIPTION OF THE PREFERRED EMBODIMENTS

Figure 1:
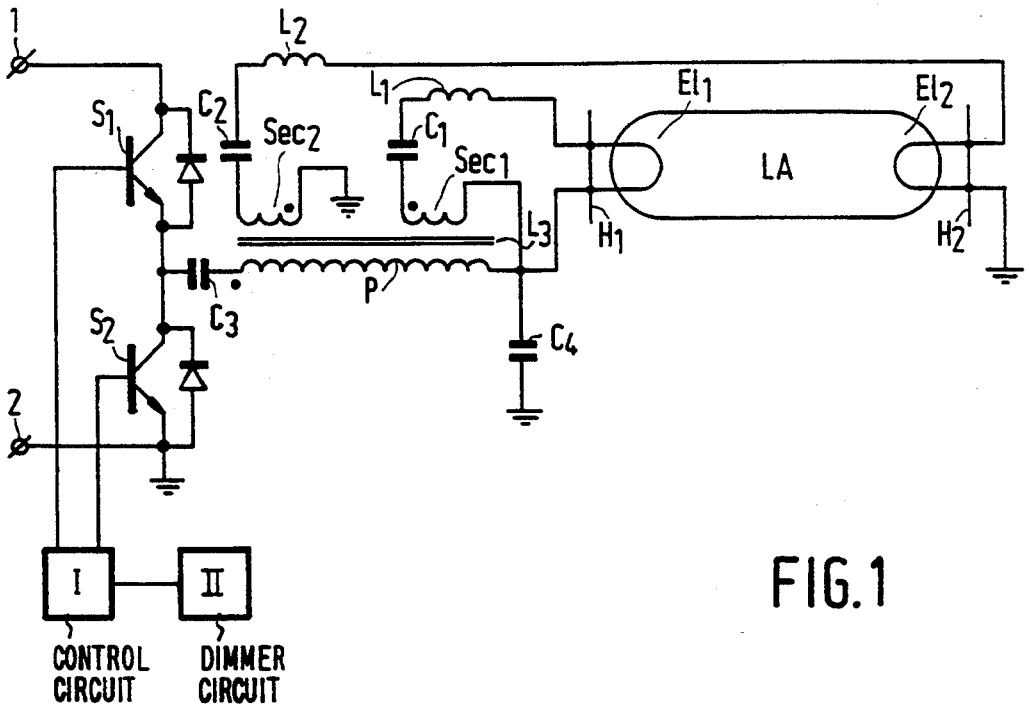
FIG. 1 shows an embodiment of a circuit arrangement according to the invention.

In FIG. 1, reference numerals 1 and 2 denote input terminals for connection to a supply voltage source. It is desirable for the circuit arrangement shown in FIG. 1 that the supply voltage source should be a DC voltage source whose anode is connected to terminal 1 and whose cathode is connected to terminal 2. Input terminals 1 and 2 are interconnected by a series circuit of two switching elements S1 and S2. Control electrodes of the switching elements are connected to respective outputs of control circuit I for generating a control signal which is to render the switching elements S1 and S2 alternately conducting and non-conducting at a high frequency. An input of control circuit I is connected to an output of dimmer circuit II which adjusts the frequency of the control signal. The load branch in this embodiment is formed by capacitors C1, C2, C3 and C4, transformer L3, coils L1 and L2, terminals H1 and H2 for accommodating a discharge lamp, and the discharge lamp La. The transformer L3 in this embodiment performs the function of electrode heating transformer as well as the function of an inductive element. A common junction point of the switching elements S1 and S2 is connected to a first side of capacitor C3. A further side of capacitor C3 is connected to a first end of primary winding P of transformer L3. A further end of primary winding P is connected to a first side of capacitor C4. A further side of capacitor C4 is connected to input terminal 2 (i.e. ground). The further end of primary winding P is also connected to a first end of electrode E11 of discharge lamp La. Electrode E11 is shunted by a series circuit of coil L1, capacitor C1, and secondary winding Sec1 of transformer L3. A first end of electrode E12 of the discharge lamp La is connected to input terminal 2. Electrode E12 is shunted by a series circuit of coil L2, capacitor C2, and secondary winding Sec2.

The operation of the circuit arrangement shown in FIG. 1 is as follows.

When the input terminals 1 and 2 are connected to the anode and cathode, respectively, of a DC voltage source, the control circuit I renders the switching elements S1 and S2 conducting and non-conducting with at a high frequency f. As a result, a high-frequency current with at the frequency f flows through the load branch. A high-frequency current with at the frequency f also flows through the two branches which shunt the secondary windings Sec1 and Sec2 of the transformer L3. When the lowest adjustable frequency of the control signal has been set by means of the dimmer circuit II, the discharge lamp La dissipates approximately its rated power and the luminous flux of the discharge lamp La has the maximum value which can be set. The load branch is so dimensioned that the frequency f has a higher value than the resonance frequency of the load branch, so that the load branch is an inductive impedance at the frequency f. In addition, the branches shunting the secondary windings Sec1 and Sec2 of transformer L3 are so dimensioned that the resonance frequencies of these branches are higher than the frequency f. The impedances of these branches as a result are capacitive. Now when the frequency of the control signal, and thus the frequency f of the high-frequency current in the load branch, is increased through operation of the dimmer circuit II, the impedance of the load branch increases. As a result, the current through the load branch decreases, and accordingly also the current through the discharge lamp La. An increase in the frequency f, however, also leads to a decrease in the impedance of the branches shunting the two secondary windings Sec1 and Sec2. The electrode heating currents flowing through these two branches are increased as a result. Conversely, the currents through the branches shunting the secondary windings Sec1 and Sec2 of the transformer L3 decrease when the discharge current is increased. Thus, an increase in the electrode heating current is achieved at a decrease in the discharge current through the lamp such that the temperatures of the electrodes E11 and E12 of the discharge lamp have such a value at every adjustable luminous flux of the discharge lamp that the electrode life is comparatively long and that substantially no blackening occurs at the ends of the discharge vessel.

Figure 2:
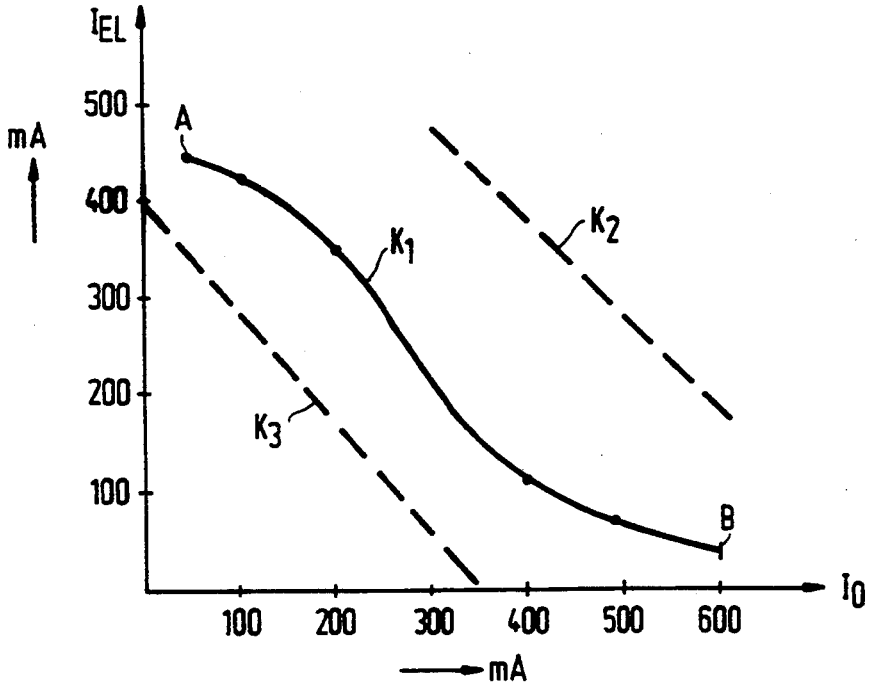
FIG. 2 shows the electrode heating current as a function of a discharge current through a lamp operated by means of a circuit arrangement as shown in FIG. 1.

In FIG. 2, the electrode heating current is plotted on the vertical axis in mA. The discharge current is plotted on the horizontal axis in mA. The discharge lamp for which the relation between discharge current and electrode heating current as shown in FIG. 2 was measured, was a low-pressure mercury discharge lamp of the PL-L type, made by Philips, with a power rating of 55 W. The curve K1 shows the measured relation between the discharge current and the electrode heating current. Points A and B on the curve K1 mark the limits of the adjustment range of the discharge current: 50 mA and 600 mA, respectively. Curves K2 and K3 give the empirically determined maximum and minimum values, respectively, of the electrode heating current for each value of the discharge current, at which the electrode life of the discharge lamp is comparatively long. FIG. 2 shows that the electrode heating current lies between the minimum and the maximum value throughout the entire adjustment range of the discharge current.

I claim:

1. A circuit arrangement for high-frequency operation of a discharge lamp, comprising:

input terminals for connection to a supply voltage source, a load branch including terminals for connecting to the discharge lamp and an electrode heating transformer provided with a primary winding and secondary windings, each secondary winding being shunted by a branch comprising an electrode of the discharge lamp, at least one switching element for generating a high-frequency current through the load branch from a supply voltage delivered by the supply voltage source, a control circuit for generating and supplying to said switching element a control signal for rendering the switching element conducting and non-conducting at a high frequency, a dimmer circuit coupled to the control circuit for adjusting the frequency of the control signal, and wherein each branch shunting a secondary winding of the transformer comprises inductive means and capacitive means and has a resonance frequency which is different from the resonance frequency of the load branch.

2. A circuit arrangement as claimed in claim 1, wherein the load branch comprises an inductive element, the resonance frequency of the load branch has a lower value than the resonance frequencies of the branches shunting the secondary windings, and the frequency of the high-frequency current through the load branch is higher for each luminous flux value of the lamp which can be set than the resonance frequency of the load branch and lower than the resonance frequencies of the branches shunting the secondary windings of the electrode heating transformer.

3. A circuit arrangement as claimed in claim 2, wherein the inductive element and the electrode heating transformer are integrated as one component.

4. The circuit arrangement as claimed in claim 1 wherein the inductive means and a secondary winding comprise a single dual function electric component.

5. A discharge lamp operating apparatus having a dimming function comprising:

input terminals for connection to a source of supply voltage, a load circuit comprising terminals for connection to respective electrodes of the discharge lamp and an electrode heating transformer including a primary winding and first and second secondary heater windings for coupling to first and second electrodes of the discharge lamp, respectively, said load circuit having a resonant frequency, at least one controlled switching element coupled to said input terminals and arranged to supply an alternating current to said load circuit, a control circuit having an output coupled to a control electrode of the controlled switching element and arranged to generate a control signal for switching the controlled switching element on and off so as to derive said alternating current for the load circuit, a dimmer circuit coupled to a control input of the control circuit for adjusting the frequency of the control signal, and inductive means and capacitive means coupled to said first and second secondary winding so as to form first and second resonant circuits each having a resonant frequency that is different than the resonant frequency of the load circuit.

6. The discharge lamp operating apparatus as claimed in claim 5 wherein said first and second resonant circuits have the same resonant frequency, the resonant frequency of the load circuit being lower than the resonant frequency of said first and second resonant circuits.

7. The discharge lamp operating apparatus as claimed in claim 5 further comprising a capacitor coupling said transformer primary winding to said at least one controlled switching element.

8. The discharge lamp operating apparatus as claimed in claim 7 further comprising a second controlled switching element connected in series circuit with the first controlled switching element to said input terminals, and wherein said capacitor is coupled between said transformer primary winding and a junction point between said first and second controlled switching elements.

9. The discharge lamp operating apparatus as claimed in claim 5 wherein said at least one controlled switching element is coupled to said transformer primary winding for supplying said alternating current to the load circuit.

10. The discharge lamp operating apparatus as claimed in claim 5 further comprising a capacitor coupling said transformer primary winding to said at least one controlled switching element, and wherein said control circuit is electrically isolated from said transformer windings.

11. The discharge lamp operating apparatus as claimed in claim 5 wherein said at least one controlled switching element is coupled to said transformer primary winding for supplying said alternating current to the load circuit, and said control circuit is electrically isolated from said transformer windings.

* * * * *